US007215316B2

(12) United States Patent
Sim et al.

(10) Patent No.: US 7,215,316 B2
(45) Date of Patent: May 8, 2007

(54) APPARATUS AND METHOD FOR DRIVING PLASMA DISPLAY PANEL

(75) Inventors: Soo Seok Sim, Kumi-shi (KR); Won Tae Kim, Kumi-shi (KR); Bon Cheol Koo, Daegu (KR); Seong Ho Kang, Daegu (KR)

(73) Assignee: LG Electronics Inc., Seoul (KR)

( * ) Notice: Subject to any disclaimer, the term of this patent is extended or adjusted under 35 U.S.C. 154(b) by 405 days.

(21) Appl. No.: 10/277,974

(22) Filed: Oct. 23, 2002

(65) Prior Publication Data

US 2003/0080927 A1 May 1, 2003

(30) Foreign Application Priority Data

Oct. 25, 2001 (KR) ..... 10-2001-65865
Oct. 25, 2001 (KR) ..... 10-2001-65866

(51) Int. Cl.
*G09G 3/36* (2006.01)

(52) U.S. Cl. ..... 345/101

(58) Field of Classification Search ..... 345/101
See application file for complete search history.

(56) References Cited

FOREIGN PATENT DOCUMENTS

| | | |
|---|---|---|
| EP | 0191511 | 11/1988 |
| EP | 0 866 439 A1 | 9/1998 |
| EP | 1136975 | 9/2001 |
| EP | 1 398 756 A2 | 3/2004 |
| JP | 09-97032 | 4/1997 |
| JP | 096283 | 10/1997 |
| JP | 10-207427 | 8/1998 |
| JP | 10207426 | 8/1998 |
| JP | 2000-227780 | 8/2000 |
| JP | 2002-207449 | 7/2002 |
| JP | 2002207449 A * | 7/2002 |
| KR | 1998-0010983 | 4/1998 |
| KR | 2000-0003326 | 1/2000 |
| WO | WO 99/30308 | 6/1999 |

OTHER PUBLICATIONS

European Search Report dated Oct. 16, 2006—in the English language.
European Search Report dated May 5, 2006.

* cited by examiner

*Primary Examiner*—Sumati Lefkowitz
*Assistant Examiner*—Ke Xiao
(74) *Attorney, Agent, or Firm*—Ked & Associates, LLP

(57) ABSTRACT

This invention relates to a driving apparatus of a plasma display panel that is capable of being operated stable, regardless of temperature.

A driving apparatus of a plasma display panel according to the present invention includes a panel having a scanning electrode for receiving a scanning pulse in an address period and an address electrode for receiving a data pulse synchronized with the scanning pulse in the address period; and a pulse width controller for changing the width of the scanning pulse when the panel is driven at a low temperature.

9 Claims, 6 Drawing Sheets

APPARATUS AND METHOD FOR DRIVING PLASMA DISPLAY PANEL

BACKGROUND OF THE INVENTION

1. Field of the Invention

This invention relates to an apparatus and a method of driving a plasma display panel, and more particularly to an apparatus and a method of driving a plasma display panel that are capable of being operated stable, regardless of temperature.

2. Description of the Related Art

A plasma display panel PDP is a display device using a phenomenon that visible ray is generated from a fluorescent substance when ultraviolet ray generated by gas discharge excites the fluorescent substance. The PDP is thinner and lighter than a cathode ray tube CRT, which has been used as main display means so far, and can be embodied of high definition and wide screen.

The PDP includes an upper substrate and a lower substrate installed facing each other with a barrier rib therebetween. The upper substrate includes the first and the second electrode formed in parallel to each other. A dielectric layer and a protective film are sequentially deposited on the first and the second electrode. The lower substrate includes an address electrode formed crossing with the first and the second electrode. A dielectric layer is formed on the address electrode to cover the address electrode. A discharge cell is positioned at an intersection of the address electrode and the first and the second electrode.

In order to express gray levels of a picture, such a PDP is driven by dividing one frame into various sub-fields having a different light-emission frequency. Each sub-field is divided again into a reset period for causing a uniform discharge, an address period for selecting a discharge cell and a sustaining period for implementing gray levels in dependence on discharge frequency.

In the reset period, a reset discharge is generated by a reset pulse supplied to the first electrode. And uniform wall charges are formed at the discharge cells by such a reset discharge. In the address period, a scanning pulse is supplied to the first electrode, and a data pulse synchronized with the scanning pulse is supplied to the address electrode. At this moment, an address discharge is generated at the discharge cells to which the scanning pulse and the data pulse are supplied. In the sustaining period, a sustaining pulse is alternately supplied to the first and the second electrode. If the sustaining pulse is supplied to the first and the second electrode, a sustaining discharge is generated at the discharge cell where the address discharge is generated.

When it is intended to display a picture of 256 gray levels, a frame period corresponding to 1/60 second (i.e. 16.67 ms) is divided into 8 sub-fields SF1 to SF8. Herein, the reset period and the address period of each sub-field are equal every sub-field, whereas the sustaining period and the discharge frequency are increased at a ratio of $2^n$ (Herein, n=0, 1, 2, 3, 4, 5, 6, 7 and 8) at each sub-field. As mentioned above, since the sustaining period is differentiated at each sub-field, gray levels of a picture can be displayed.

The conventional PDP driven in this way has a wrong discharge generated anywhere than at the area where its normal operation temperature is 0~40° C. In other words, the wrong discharge phenomenon occurs below the temperature of 0° C. when experimenting performance characteristic of the PDP depending on the operation temperature. Particularly, when the PDP is operated below 0° C., a miswriting phenomenon occurs in the address period and a strong sustaining discharge, which is not intended, is generated in the sustaining period.

To describe more particularly, the scanning pulse supplied to the first electrode can be set at 1.3 μs, as in FIG. 1, in the address period of the PDP. If the scanning pulse set at a specific width in this way is supplied to the first electrode Y and the data pulse is supplied to the address electrode X, an address discharge is generated at the discharge cell. At this moment, because a discharge delay is small at the temperature not low (over 0° C.), a discharge occurrence time is positioned within a scanning pulse width, thereby generating a stable address discharge.

However, because the discharge delay is bigger at the low temperature (below 0° C.) than at the temperature not low, the discharge is possible not to be generated within the pulse width of the scanning pulse, i.e., 1.3 μs. In other words, the discharge occurrence time is positioned after the scanning pulse width by the discharge delay at the low temperature (below 0° C.), as shown in FIG. 1, to have the miswriting occur in the address period. On the other hand, the worse such a miswriting phenomenon occurs, the bigger the wide screen is and the higher the resolution is of the PDP.

Also, the polarization phenomenon of the dielectric layer formed on the upper and the lower substrate occurs faster at the temperature below 0° C. than at the temperature over 0° C.

Like this, if the polarization phenomenon of the dielectric layer occurs faster, the sustaining discharge can be easily generated with low voltage. Therefore, at the temperature below 0° C., the sustaining discharge generates a light with its brightness higher than an intended gray level.

On the other hand, because the discharge gas is activated, the discharge is easily generated with low voltage. Consequently, when the surrounding the temperature is over 40° C., the light is generated with its brightness higher than the intended gray level upon the sustaining discharge.

SUMMARY OF THE INVENTION

Accordingly, it is an object of the present invention to provide an apparatus and a method of driving a plasma display panel that are capable of being operated stable, regardless of temperature.

In order to achieve these and other objects of the invention, a driving apparatus of a plasma display panel according to an aspect of the present invention includes a panel having a scanning electrode for receiving a scanning pulse in an address period and an address electrode for receiving a data pulse synchronized with the scanning pulse in the address period; and a pulse width controller for changing the width of the scanning pulse when the panel is driven at a low temperature.

Herein, the pulse width controller sets the width of the scanning pulse wider when the panel is driven at the low temperature.

Herein, the low temperature is below 0° C.

In the driving apparatus, the pulse width controller includes a thermal sensor for sensing the temperature of the panel; a memory stored with the width of the scanning pulse to be supplied to the panel and the number of sub-fields corresponding to the width of the scanning pulse at the low temperature; and a determining part for determining the temperature sensed at the thermal sensor and retrieving the information stored at the memory when the determined temperature is the low temperature.

The driving apparatus further includes a waveform generator for setting the width of the scanning pulse supplied to the panel in accordance with the width of the scanning pulse supplied from the determining part; and a sub-field mapping unit for controlling the number of sub-fields in accordance with the number of the sub-fields supplied from the determining part.

Herein, the low temperature is divided into plurality of temperature levels and the memory stores the number of sustaining pulses and the width of the scanning pulse corresponding to the temperature level.

Herein, the temperature level is divided-with a specific gap, and the width of the scanning pulse stored at the memory gets wider if the temperature level is lowered.

Herein, the thermal sensor is installed at a heatproof plate of the panel.

A method of driving a plasma display panel according to another aspect of the present invention includes steps of sensing an operation temperature of a panel; and widely setting the width of a scanning pulse supplied to a scanning electrode when the panel is operated at a low temperature.

In the method, the low temperature is below 0° C.

In the method, the number of sub-fields included in one frame is controlled to correspond to the width of the scanning pulse when the width of the scanning pulse is set wide.

A driving apparatus of a plasma display panel according to still another aspect of the present invention includes a panel having a first and a second electrode for receiving a plurality of sustaining pulses in a sustaining period; and a pulse number controller for reducing the number of the scanning pulses when the panel is driven at a low temperature and at the high temperature.

Herein, the low temperature is below 0° C.

Herein, the low temperature is over 40° C.

The driving apparatus further includes a waveform generator for setting the number of the sustaining pulses by the control of the pulse number controller.

In the driving apparatus, the pulse number controller includes a sensor for sensing an operation temperature of the panel; a memory for storing a time interval while the sustaining pulse is reduced, a ratio in which the sustaining pulse is reduced, and a minimal sustaining pulse number; and a transmitter for retrieving the information stored at the memory and supplying to the waveform generator when the temperature sensed at the sensor is a high temperature and the low temperature.

Herein, the waveform generator reduces the number of the sustaining pulse in accordance with the time interval while the sustaining pulse transmitted from the transmitter is reduced and the ratio in which the sustaining pulse is reduced.

Herein, the waveform generator supplies the sustaining pulses as many as the number of minimal sustaining pulses if the number of the reduced sustaining pulse is smaller than the number of the minimal sustaining pulses set at the memory.

The driving apparatus further includes an APL controller for generating a signal of a specific step in order to control the number of the sustaining pulses.

In the driving apparatus, the pulse number controller includes a sensor for sensing an operation temperature of the panel; a counter for counting when the temperature sensed at the sensor is the low temperature and a high temperature; an APL adder for adding the value supplied from the counter and temporarily storing it; an adder for adding the value supplied from the APL controller and the APL adder; and a comparator for comparing the value outputted from the adder with the value of a maximal step of the APL controller.

Herein, the comparator outputs a smaller value between the value outputted from the adder and the maximal value of the APL controller.

Herein, the number of the sustaining pulses is reduced if the value of the APL controller is increased.

In the driving apparatus, the sensor includes a first thermal sensor for detecting the low temperature; and a second thermal sensor for detecting the high temperature.

Herein, the first and the second thermal sensors are installed at a heatproof plate that supports the panel.

A method of driving a plasma display panel according to still another aspect of the present invention includes steps of sensing an operation temperature of a panel; and reducing the number of sustaining pulses when the panel is driven at a low temperature and a high temperature.

In the method, the low temperature is below 0° C.

In the method, the high temperature is over 40° C.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

With reference to FIG. 2 to 6, there are explained preferred embodiments of the present invention as follows.

Figure 1:
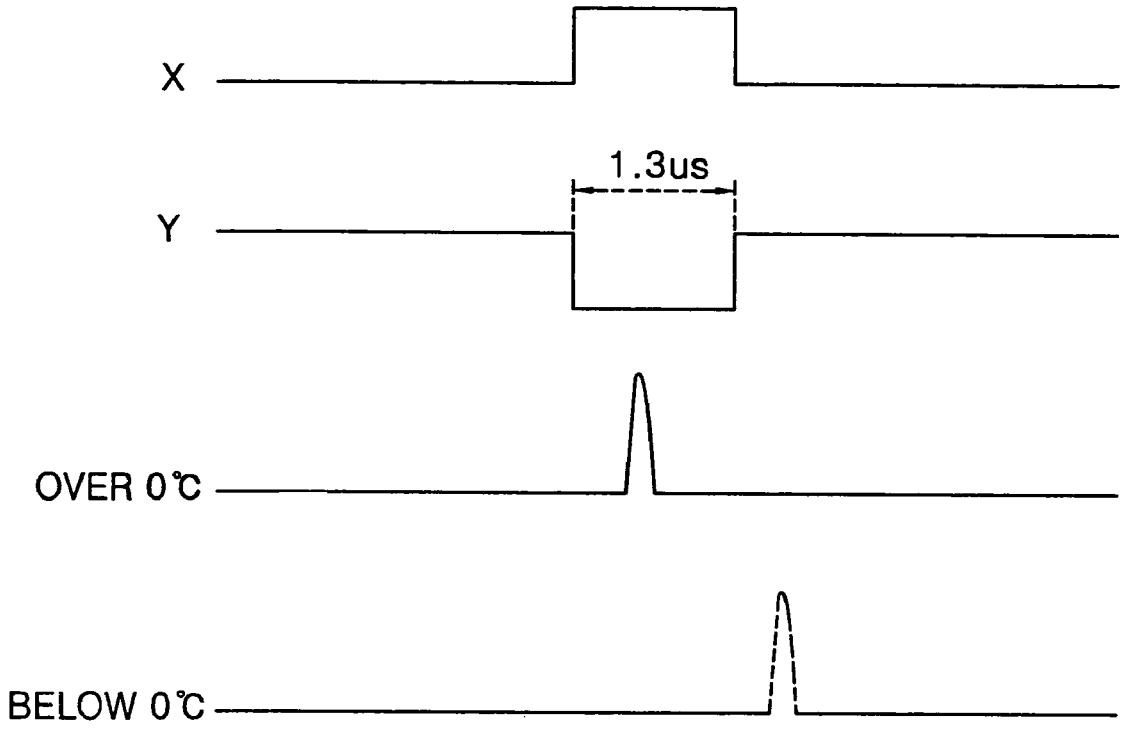
FIG. 1 RELATED ART
FIG. 1 depicts a discharge occurrence time positioned different in dependence on temperature.
Figure 2:
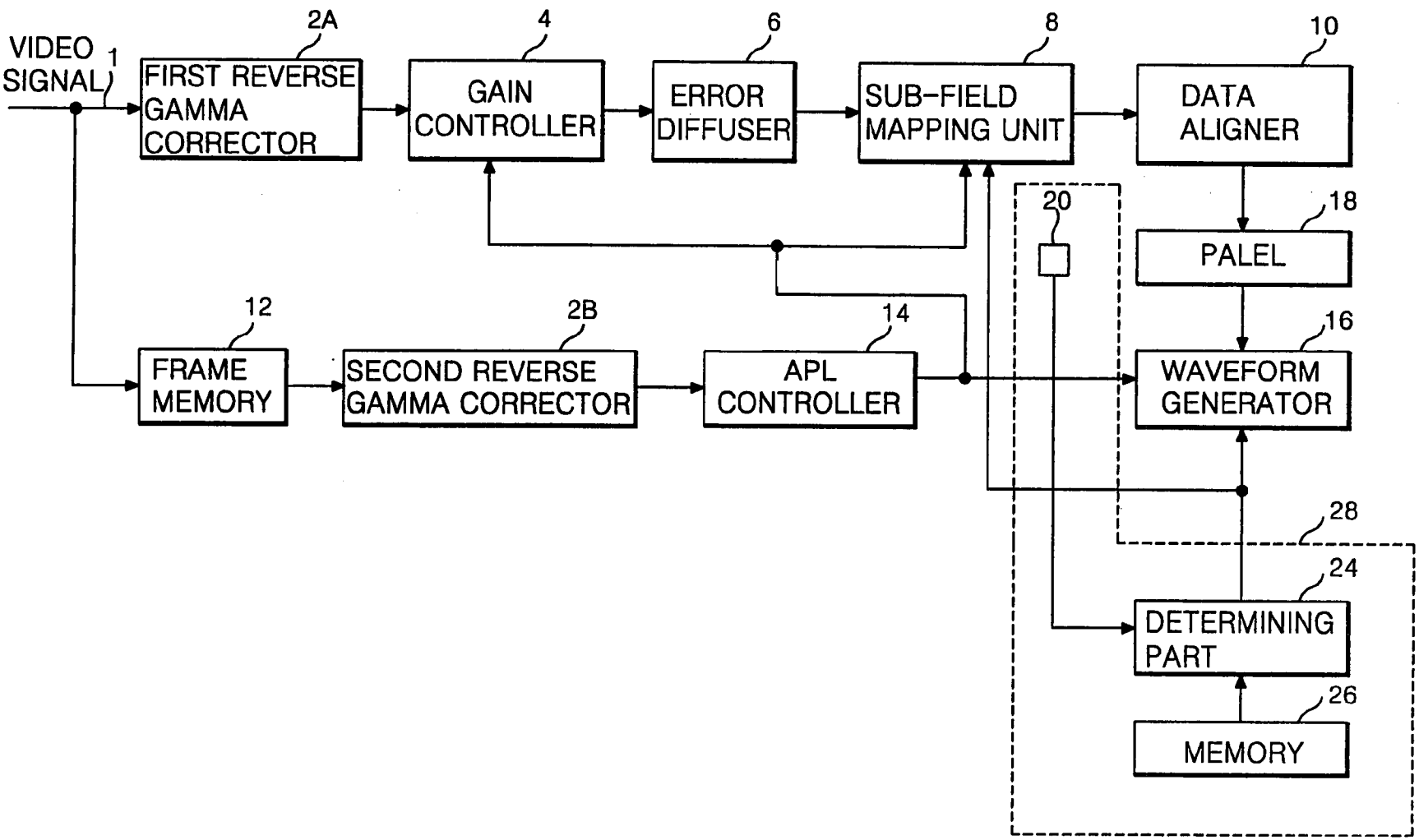
FIG. 2 is a block diagram illustrating a driving apparatus of a plasma display panel according to the first embodiment of the present invention.

FIG. 2 is a block diagram illustrating a driving apparatus of a plasma display panel according to the first embodiment of the present invention.

Referring to FIG. 2, a driving apparatus of a PDP according to the first embodiment of the present invention includes the first reverse gamma corrector 2A connected between an input line 1 and a panel 18, a gain controller 4, an error diffuser 6, a sub-field mapping unit 8 and a data aligner 10; a frame memory 12 connected between the input line land the panel 18, the second reverse gamma corrector 2B, an average picture level APL controller 14 and a waveform generator 16; a pulse width controller 28 for widely setting the width of a scanning pulse supplied to the first electrode and reducing the number of sub-fields when driving the panel 18 at the low temperature (below 0° C.).

The first and the second reverse gamma corrector 2A and 2B applies reverse gamma correction to a gamma corrected video signal to linearly convert the brightness value in dependence on the gray level value of a video signal. The frame memory 12 stores the data R,G,B of one frame portion and supplies the stored data to the second reverse gamma corrector 2B.

The APL controller 14 receives the video data corrected by the second reverse gamma corrector 2B to generate N (N is an integer) step signal for controlling the number of sustaining pulses. The gain controller 4 amplifies the corrected video data from the first reverse gamma corrector 2A as much as effective gain.

The error diffuser 6 diffuses an error component of a cell to the adjacent cells to finely control the brightness value. The sub-field mapping unit 8 re-allots the video data corrected from the error diffuser 6 by sub-fields.

The data aligner 10 converts the video data inputted from the sub-field mapping unit 8 to be suitable for the resolution format of the panel 18, and then supplies to an address driving integrated circuit IC of the panel 18.

The waveform generator 16 generates a timing control signal by the inputted N step signal from the APL controller 14 and supplies the generated timing control signal to the address driving IC, a scanning driving IC and a sustaining driving IC of the panel 18.

The pulse width controller 28 controls the width of the scanning pulse in correspondence to the operation temperature of the panel 18. For this, the pulse width controller 28 includes a thermal sensor 20 for sensing the operation temperature of the panel 18, a determining part 24 for judging the temperature sensed at the thermal sensor 20, and a memory 26 for storing specific information.

The thermal sensor 20 is installed at a heatproof plate (not shown) or a place where the surrounding temperature of the panel 18 can be sensed when the panel 18 being operated. Hall element, where its resistance is changed in proportion to temperature, can be used for such a thermal sensor 20.

In the memory 26, the width of the scanning pulse corresponding to temperature and the number of sub-fields are stored. The lower the temperature is, the wider the width of the scanning pulse stored at the memory 26 is set. For instance, if the scanning pulse width of the panel 18 is set to be 1.2 μs at the temperature not low (over 0° C.), the scanning pulse width is set to be 1.2 μs or more at the low temperature (below 0° C.). In other words, the scanning pulse width corresponding to the temperature of 0° C.~−9° C. can be set to be 2 μs in the memory 26. Also, in the memory 26, the number of sub-fields is set to correspond to the scanning pulse width of 2 μs. In this way, the number of sub-field and the scanning pulse width corresponding to the temperature such as −10° C.~−19° C.,−20° C.~−29° C., −30° C.~−39° C. and −40° C.~−49° C. etc are stored in the memory 26.

The determining part 24 determines the sensed temperature from the thermal sensor 20, and retrieves the scanning pulse width corresponding to this and the number of sub-field from the memory 26 to transmits to the waveform generator 16 and the sub-field mapping unit 8.

To describe the operation process more particularly, the thermal sensor 20 senses the driving temperature of the panel 18 and supplies to the determining part 24. The determining part 24 determines if the driving temperature of the PDP 18 is the low temperature (below 0° C.). If the driving temperature of the PDP 18 is not the low temperature (below 0° C.), the determining part 24 does not send a control signal to the waveform generator 16 and the sub-field mapping unit 8. Therefore, the panel 18 is driven with a normal scanning pulse width.

However, if it is determined in the determining part 24 that the driving temperature of the PDP 18 is the low temperature (below 0° C.), the number of sub-fields and the scanning pulse width corresponding to the temperature are retrieved from the memory 26. For example, if the driving temperature of the panel 18 inputted from the thermal sensor 20 is −15° C., the determining part 24 retrieves then umber of sub-fields and the scanning pulse width corresponding to −15° C. from the memory 26.

The determining part 24, which have retrieved the number of sub-fields and the scanning pulse width corresponding to a specific temperature, transmits the number of sub-fields and the scanning pulse width to the waveform generator 16 and the sub-field mapping unit 8. The sub-field mapping unit 8 re-allots the video data in accordance with the number of the sub-fields transmitted from the determining part 24.

The waveform generator 16 generates a timing control signal corresponding to the scanning pulse width transmitted from the determining part 24 to supply to the scanning driving IC. At this moment, the waveform generator 16 can set the width of the address pulse the same as the width of the scanning pulse.

Figure 3:
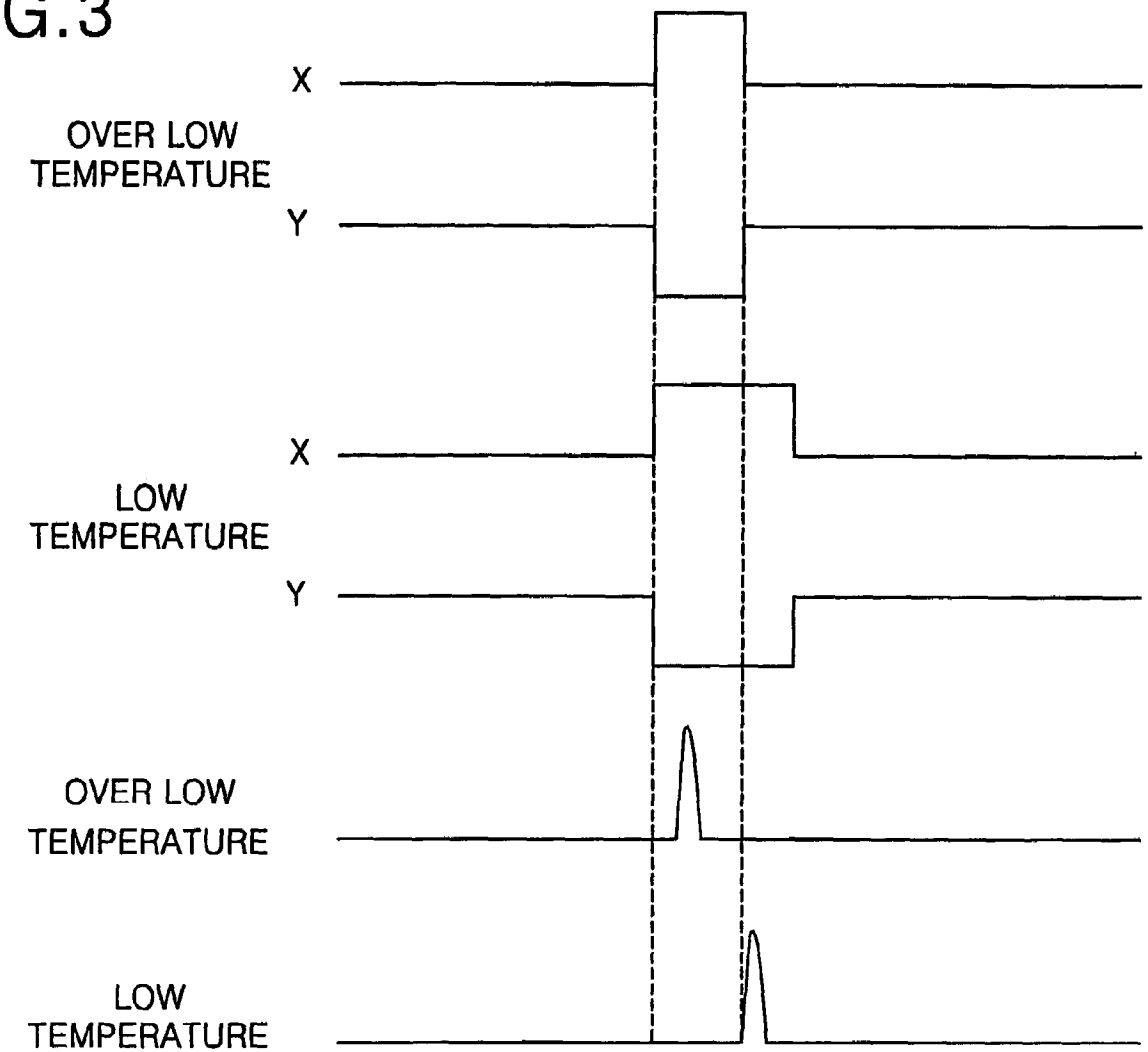
FIG. 3 depicts a discharge occurrence time according to the plasma display panel of the present invention shown in FIG. 2.

In the PDP according to the embodiment of the present invention, the scanning pulse width is set wide at the low temperature (below 0° C.), as in FIG. 3. In this way, if the scanning pulse width is set wide, a discharge delay can be compensated at the low temperature (below 0° C.) That is, because the discharge occurrence time is positioned within the scanning pulse width even at the low temperature (below 0° C.), as in FIG. 3, it is possible to prevent the miswriting of the discharge cell.

Figure 4:
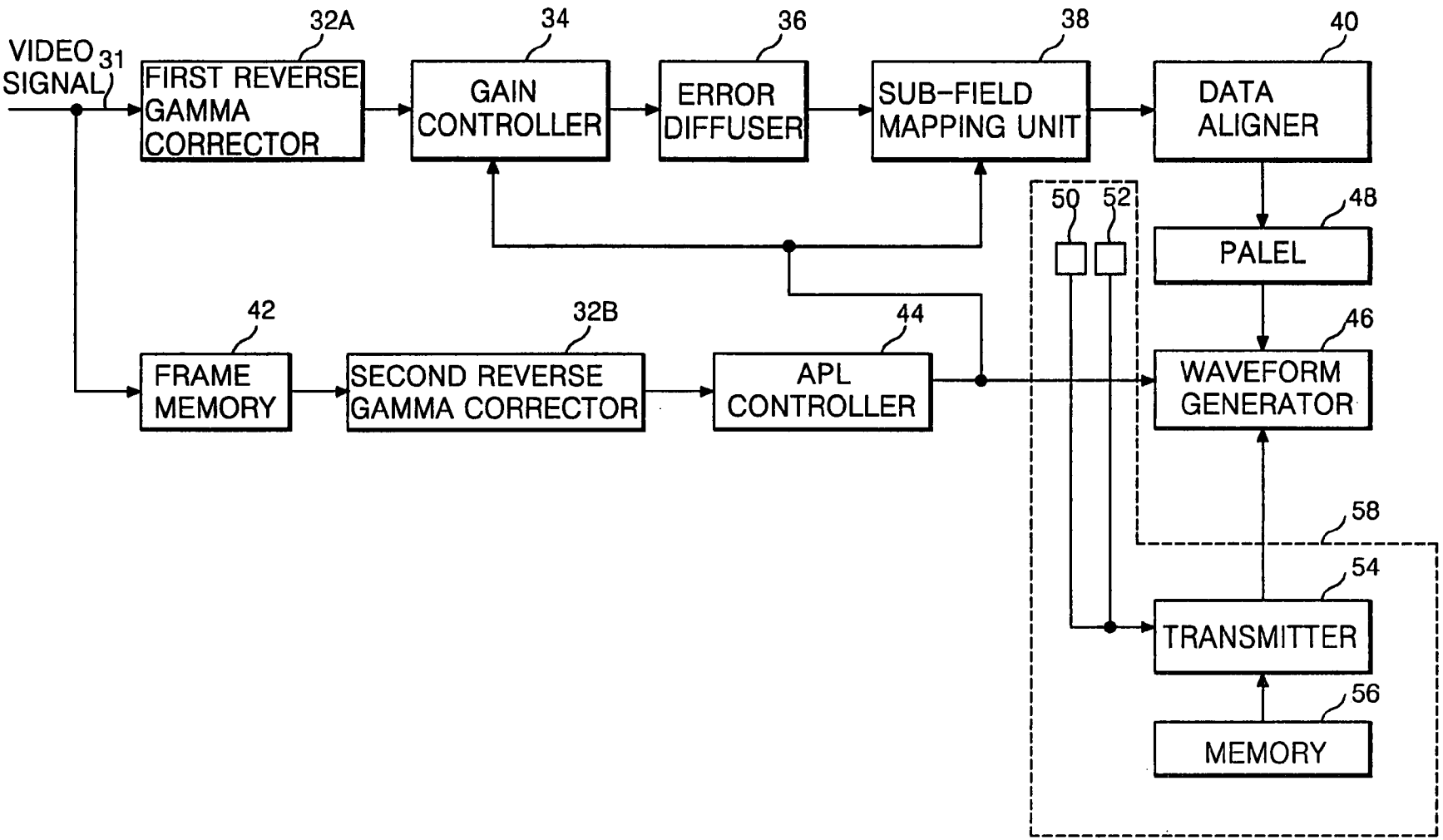
FIG. 4 is a block diagram illustrating a driving apparatus of a plasma display panel according to the second embodiment of the present invention.

FIG. 4 is a block diagram illustrating a driving apparatus of a plasma display panel according to the second embodiment of the present invention.

Referring to FIG. 4, a driving apparatus of a PDP according to the second embodiment of the present invention includes the first reverse gamma corrector 32A connected between an input line 31 and a panel 48, a gain controller 34, an error diffuser 36, a sub-field mapping unit 38 and a data aligner 40; a frame memory 42 connected between the input line 31 and the panel 48, the second reverse gamma corrector 32B, an average picture level APL controller 44 and a waveform generator 46; a pulse number controller 58 for reducing the sustaining number when the panel 48 is operated at the temperature other than normal temperature.

The first and the second reverse gamma corrector 32A and 32B applies reverse gamma correction to a gamma corrected video signal to linearly convert the brightness value in dependence on the gray level value of a video signal. The frame memory 42 stores the data R,G,B of one frame portion and supplies the stored data to the second reverse gamma corrector 32B.

The APL controller 44 receives the video data corrected by the second reverse gamma corrector 32B to generate N step signal for controlling the number of sustaining pulses. The gain controller 34 amplifies the corrected video data from the first reverse gamma corrector 32A as much as effective gain.

The error diffuser 36 diffuses an error component of a cell to the adjacent cells to finely control the brightness value. The sub-field mapping unit 38 re-allots the video data corrected from the error diffuser 36 by sub-fields.

The data aligner 40 converts the video data inputted from the sub-field mapping unit 38 to be suitable for the resolution format of the panel 48, and then supplies to an address driving integrated circuit IC of the panel 48.

The waveform generator 46 generates a timing control signal by the inputted N step signal from the APL controller 44 and supplies the generated timing control signal to the address driving IC, a scanning driving IC and a sustaining driving IC of the panel 48.

The pulse number controller 58 includes the first and the second thermal sensor 50 and 52 for sensing the operation temperature of the panel 48, a transmitter 54 for controlling the waveform generator 46, and a memory 56 for storing specific information.

The first and the second thermal sensor 50 and 52 are installed at a heatproof plate (not shown) or a place where the surrounding temperature of the panel 48 can be sensed when the panel 48 being operated. In the memory 56 is stored information such as time interval while the sustaining pulse has been reduced, the ratio in which the sustaining pulse is reduced, and the minimal number of sustaining pulses etc. The transmitter 54 retrieves the information stored at the memory 56 in correspondence to the temperature information supplied from the first and the second thermal sensor 50 and 52, and supplies the retrieved information to the waveform generator 46.

To describe the operation process of the pulse number controller 58 more particularly, first the first thermal sensor 50 generates the control signal of '1' and supplies to the transmitter 54 when the panel 48 is operated at the low temperature (below 0° C.).

The second thermal sensor 52 generates the control signal of '1' and supplies to the transmitter 54 when the panel 48 is operated at the high temperature (over 40° C.).

The transmitter 54 received the control signal of '1' from the first thermal sensor 50 or the second thermal sensor 52 retrieves the information stored at the memory 56 and supplies to the waveform generator 46. The waveform generator 46, which receives the contents stored at the memory 56, generates a timing control signal in order to reduce the number of the sustaining pulse to the extent of the ratio that is set at the memory 56.

To describe this more particularly, it is supposed that the time interval while the number of sustaining pulse is reduced is set to be 1 second, the ratio in which the number of sustaining pulse is reduced is set to be 2%, and the minimal number of the sustaining pulse is set to be 200 at the memory 56. And, it is also supposed that the timing control signal to be supplied from the waveform generator 46 designates the number of sustaining pulse of 1000.

At this moment, if the control signal of 'a' is supplied to the transmitter 54, the transmitter 54 retrieves the contents stored at the memory 56 to supply to the waveform generator 46. Then, the waveform generator 46 reduces the number of sustaining pulses to be currently supplied in the ratio of 2% per second. On the other hand, if the number of the sustaining pulse is 200 or less, the number of the sustaining pulse is not reduced any more.

That is, in the second embodiment of the present invention, the operation temperature of the PDO is watched to see if the PDO is operated at the temperature other than normal temperature (0° C.~40° C.). If it is, the number of sustaining pulse is reduced.

That is, in the second embodiment of the present invention, when the PDP is operated at the low temperature or at the high temperature, the number of sustaining pulse is reduced, thereby preventing the brightness of the gray level not intended from being displayed in the panel 48.

Figure 5:
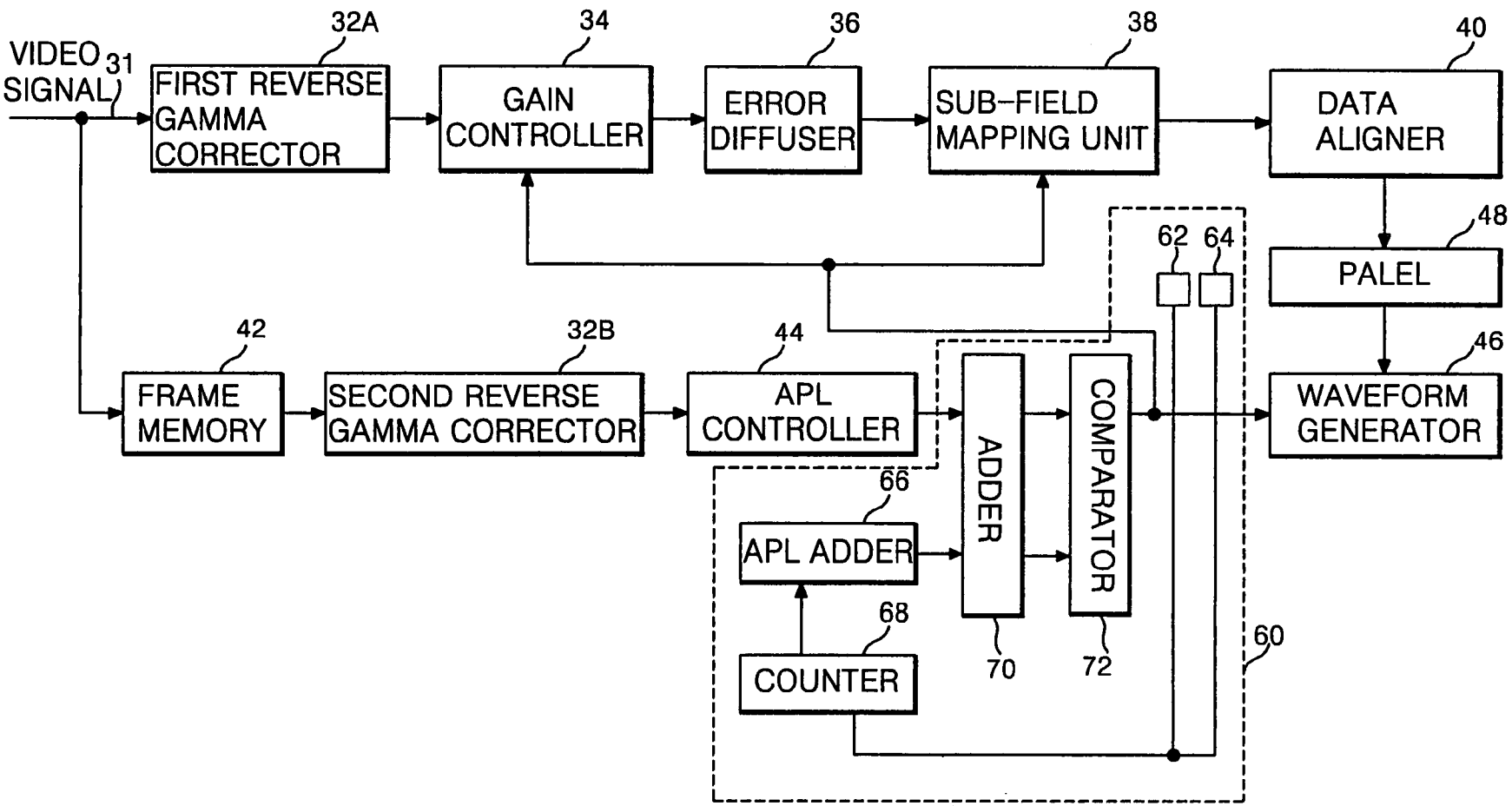
FIG. 5 is a block diagram illustrating a driving apparatus of a plasma display panel according to the third embodiment of the present invention.
Figure 6:
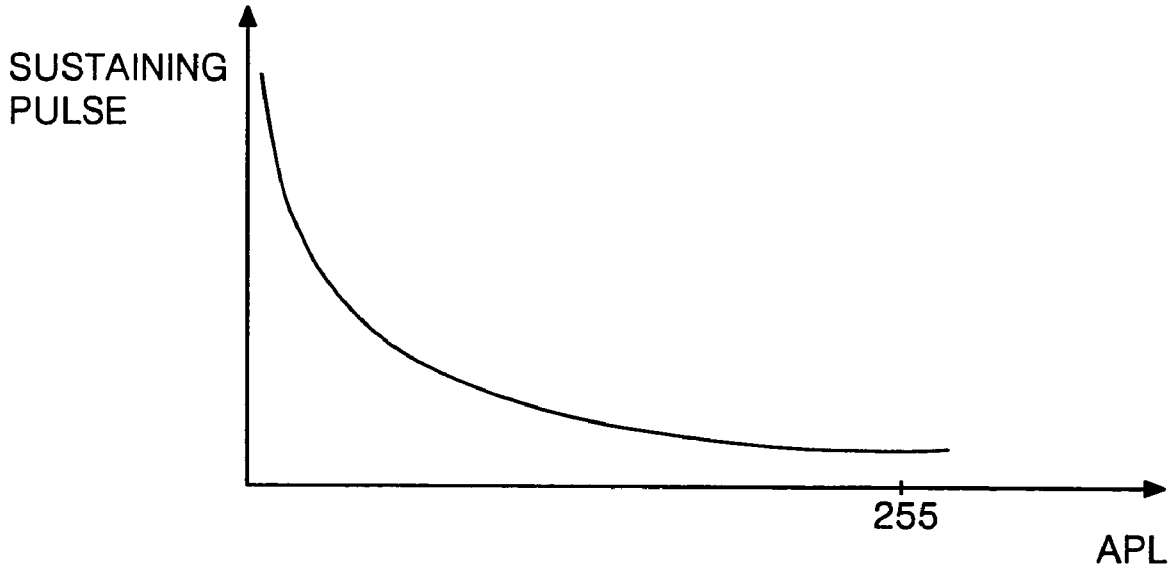
FIG. 6 is a diagram showing the number of sustaining pulses corresponds to average picture level.

FIG. 5 is a block diagram illustrating a driving apparatus of a plasma display panel according to the third embodiment of the present invention. The devices, which function the same as in FIG. 4, are allotted the same reference numeral in FIG. 5, and the detailed operation process will be omitted.

Referring to FIG. 5, a driving apparatus of a PDP according to the third embodiment of the present invention includes the first reverse gamma corrector 32A connected between an input line 31 and a panel 48, a gain controller 34, an error diffuser 36, a sub-field mapping unit 38 and a data aligner 40; a frame memory 42 connected between the input line 31 and the panel 48, the second reverse gamma corrector 32B, an average picture level APL controller 44, a pulse number controller 60 and a waveform generator 46.

The pulse number controller 60 includes the first and the second thermal sensor 62 and 64, a counter 68, an APL adder 66, an adder 70 and a comparator 72.

The first and the second thermal sensor 62 and 64 are installed at a heatproof plate or a place where the operation temperature of the panel 48 can be sensed so as to sense the operation temperature of the panel 48. The counter 68 supplies a specific value to the APL adder 66 by the control of the first and the second thermal sensor 62 and 64. The APL adder 66 adds the value supplied from the counter 68 and supplies the added value to the adder 70. The adder 70 adds the value supplied from the APL controller and APL adder 66 to supplied to the comparator 72. The comparator 72 compares the value of the maximal step (e.g., 255) possible to be generated at the APL controller 44 with the value inputted from the adder 70 and supplies the smaller value to the waveform generator 46.

To describe the operation process of the pulse number controller 60 more particularly, first the first thermal sensor 62 generates the control signal of '1' and supplies to the counter 68 when the panel 48 is operated at the low temperature (below 0° C.).

The second thermal sensor 64 generates the control signal of '1' and supplies to the counter 68 when the panel 48 is operated at the high temperature (over 40° C.).

The counter 68, which receives the control signal of '1' from the first thermal sensor 62 or the second thermal sensor 64, supplies the value increasing in the ratio of "1, 2, 3, 4, . . . " to the APL adder 66. On the other hand, the counter 68 can supply a specific value, e.g., the value increasing by 1 from 100.

The APL adder 66 adds the numbers supplied from the counter 68. For example, if "1, 2, 3" are the numbers supplied from the counter, the APL adder 66 stores the value "6" temporarily. The temporarily stored value at the APL adder 66 is supplied to the adder 70. The adder 70 adds the signal level of a specific step supplied from the APL controller 44 to the value inputted from the APL adder 68. For example, if "100" is inputted from the APL controller 44, "106" is temporarily stored at the adder 70.

Then, the value stored at the adder 70 is inputted to the comparator 72. The comparator 72 compares the value of the maximal step, which can be outputted from the APL controller 44 with the value inputted from the adder 70. If the maximal step of the APL controller 44 is "255" as in FIG. 6, the adder 72 compares "255" with the value inputted from the adder 70.

After that, the comparator 72 supplies the smaller value between the value inputted from the APL controller 44 and the value inputted from the adder 70 to the waveform generator. That is, in the third embodiment of the present invention, the step of the APL is increased when the panel 48 is driven at the low temperature or at the high temperature. In this way, if the step of the APL is increased, the number of the sustaining pulses is reduced in accordance with the graph of FIG. 6. That is, in the third embodiment of the present invention, the number of sustaining pulse is reduced when the panel 48 is driven at the low temperature or at the high temperature, thereby preventing the brightness of the gray level not intended from being displayed in the panel 48.

As described above, according to the driving apparatus and driving method of the plasma display panel of this invention, the number of sustaining pulses is reduced when the plasma display panel is driven at the low temperature or at the high temperature, thereby preventing the brightness of the gray level not intended from being displayed in the panel. In addition, the width of the scanning pulse is set wide when the panel is driven at the low temperature, thereby preventing the miswriting from being generated in the address period.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus of a plasma display panel, comprising:

a panel having a scanning electrode for receiving a scanning pulse in an address period and an address electrode for receiving a data pulse synchronized with the scanning pulse in the address period; and a pulse width controller for changing a width of the scanning pulse when the panel is driven below a predetermined temperature, wherein the pulse width controller includes;

a thermal sensor to sense a temperature of the panel;

a memory to store information indicative of a width of the scanning pulse to be supplied to the panel and indicative of a number of sub-fields corresponding to the width of the scanning pulse below the predetermined temperature; and a determining circuit to determine the temperature sensed by the thermal sensor and retrieve the information stored in the memory when the sensed temperature is determined to be below the predetermined temperature.

2. The driving apparatus according to claim 1, wherein the pulse width controller sets the width of the scanning pulse wider when the panel is driven below the predetermined temperature.

3. The driving apparatus according to claim 1, wherein the predetermined temperature is substantially 0° C.

4. The driving apparatus according to claim 1, further comprising:

a waveform generator for setting the width of the scanning pulse supplied to the panel in accordance with the width of the scanning pulse determined from the information retrieved by the determining circuit; and a sub-field mapping circuit for controlling video data in accordance with the number of the sub-fields determined from the information retrieved by the determining circuit.

5. The driving apparatus according to claim 1, wherein the memory stores information indicative of a number of sustaining pulses and a width of the scanning pulse for each of a plurality of temperature levels below the predetermined temperature.

6. The driving apparatus according to claim 5, wherein the temperature levels are divided with a specific gap, and the width of the scanning pulse stored at the memory gets wider as the temperature level is lowered.

7. The driving apparatus according to claim 1, wherein the thermal sensor is installed at a heatproof plate of the panel.

8. A method of driving a plasma display panel, comprising steps of:

sensing an operation temperature of a panel; and increasing a width of a scanning pulse supplied to a scanning electrode when the panel is operated below a predetermined temperature, wherein a number of sub-fields included in one frame is controlled to correspond to the increased width of the scanning pulse when the panel is operated below the predetermined temperature.

9. The method according to claim 8, wherein the predetermined temperature is substantially 0° C.

* * * * *